US005186536A

United States Patent [19]

Bornhorst et al.

[11] Patent Number: 5,186,536

[45] Date of Patent: Feb. 16, 1993

[54] LIGHTING INSTRUMENT WITH MOVABLE FILTERS AND ASSOCIATED ACTUATION MECHANISM

[75] Inventors: James M. Bornhorst, De Soto; Timothy D. Stacy, Plano, both of Tex.

[73] Assignee: Vari-Lite, Inc., Dallas, Tex.

[21] Appl. No.: 809,698

[22] Filed: Dec. 16, 1991

Related U.S. Application Data

[63] Continuation-in-part of Ser. No. 578,594, Sep. 6, 1990, Pat. No. 5,073,847.

[51] Int. Cl.[5] ..... F21V 9/00

[52] U.S. Cl. ..... 362/293; 362/283; 362/281

[58] Field of Search ..... 362/293, 281, 283, 277

[56] References Cited

U.S. PATENT DOCUMENTS 1,619,198 3/1927 Edison .
2,913,572 11/1959 Fritzlen .
3,080,474 3/1963 Allen .
3,426,189 2/1969 Deputy .
3,604,922 9/1971 Steel .
3,609,339 9/1971 Smith .
4,602,321 7/1986 Bornhorst .
4,974,136 11/1990 Noori-Shad et al. .
4,980,806 12/1990 Taylor .

*Primary Examiner*—Carroll B. Dority
*Attorney, Agent, or Firm*—Morgan & Finnegan

[57] ABSTRACT

A lighting instrument having pivotable color filters arranged in a substantially radial arrangement with respect to a projected light beam. Multiple sets of such filters are spaced along the axis of the light beam to vary the color of the light beam emitted from the instrument. A motorized mechanism rotates each filter of each set in synchronization with each other and independently with respect to filters of the other sets. The filters may be rotated by the motorized mechanism through flexible coupling mechanisms. The filters also may be positioned to pass unfiltered light to vary the saturation of the light beam.

16 Claims, 13 Drawing Sheets

LIGHTING INSTRUMENT WITH MOVABLE FILTERS AND ASSOCIATED ACTUATION MECHANISM

This application is a continuation-in-part of patent application Ser. No. 578,594, filed Sep. 6, 1990 and now U.S. Pat. No. 5,073,847, the disclosure of which is incorporated herein by reference.

TECHNICAL FIELD OF THE INVENTION

The present invention relates to lighting instruments, and more particularly to a light source having movable color filters and associated actuation mechanism.

BACKGROUND OF THE INVENTION

It is known in the field of automated stage lighting to include lighting instruments having motorized controls for adjusting the azimuth and elevation, the color, and the angle of divergence of the light beam.

One mechanism which is commonly used for adjusting the color of the light beam includes a scrolling gel changer, which is a motorized remotely-controlled device for exchanging colored sheets of transparent plastic material disposed in front of conventional lighting instruments. For example, the scrolling gel changer may be installed in a Par 64 incandescent lamp for color adjustment.

For improved color changing effects, dichroic filters are used in place of the color gels. The VARI*LITE® VL3 TM automated wash luminaire includes a 475 watt incandescent lamp and a motorized cross-fading color changer which utilizes multiple sets of pivoting dichroic color filters. This, lighting instrument, disclosed in U.S. Pat. Nos. 4,392,187 and 4,602,321, both granted to J. Bornhorst, combines the pioneering dichroic filter color changing technology with incandescent light. The VARI*LITE® VL4 TM automated wash luminaire combines the motorized cross-fading dichroic filter color changer with a 400 watt arc lamp, which combination produces, in addition to a wide range of other hues, many dramatic blue hues owing to the spectral characteristics of arc lamps.

According to the present invention, a new configuration of pivoting dichroic color filters in a radial arrangement is introduced. This configuration is especially well-suited for placement in the front of a large circular lamp such as a Par 64.

Another aspect of the invention of the present application relates to a drive arrangement which removes the disadvantages associated with gear driven mechanisms. For example, in a gear driven color filter assembly, the ring gear and filter gears must be fabricated to close tolerances and mounted in precisely maintained relation to each other to avoid problems associated with the meshing of the gear teeth. Gear mesh must be properly adjusted to eliminate backlash or else the accuracy and precision of the color changer will suffer. Gear mesh must also be properly maintained to avoid excessive friction between gears which results in excessive wear and may also cause the moving mechanism to jam. Since gear drives are commonly used in instances of high load requiring the transmission of high torque or high power, expensive and precise gear parts are required.

Therefore, a need exists for a new mechanical drive arrangement for radially arranged glass filter panels which exhibits zero backlash, low friction and low cost.

The drive arrangement must provide a known and repeatable kinematic relationship between its moving parts so as to be reliable and durable.

SUMMARY OF THE INVENTION

In accordance with the present invention, a lighting instrument projects a light beam of variable color along a longitudinal axis. At least one set of color filters is disposed generally radially about the longitudinal axis of the light beam. Each filter of the set is pivotable about an axis of rotation generally transverse to the longitudinal axis. Each filter of the set may be flexibly coupled to a ring which in turn is coupled to a motor. When the motor actuates, the ring rotates about the longitudinal axis, causing each coupled filter of the set to rotate.

BRIEF DESCRIPTION OF THE DRAWINGS

A more complete understanding of the present invention may be had by reference to the following Detailed Description read in conjunction with the accompanying drawings, wherein.

DETAILED DESCRIPTION

Figure 1:
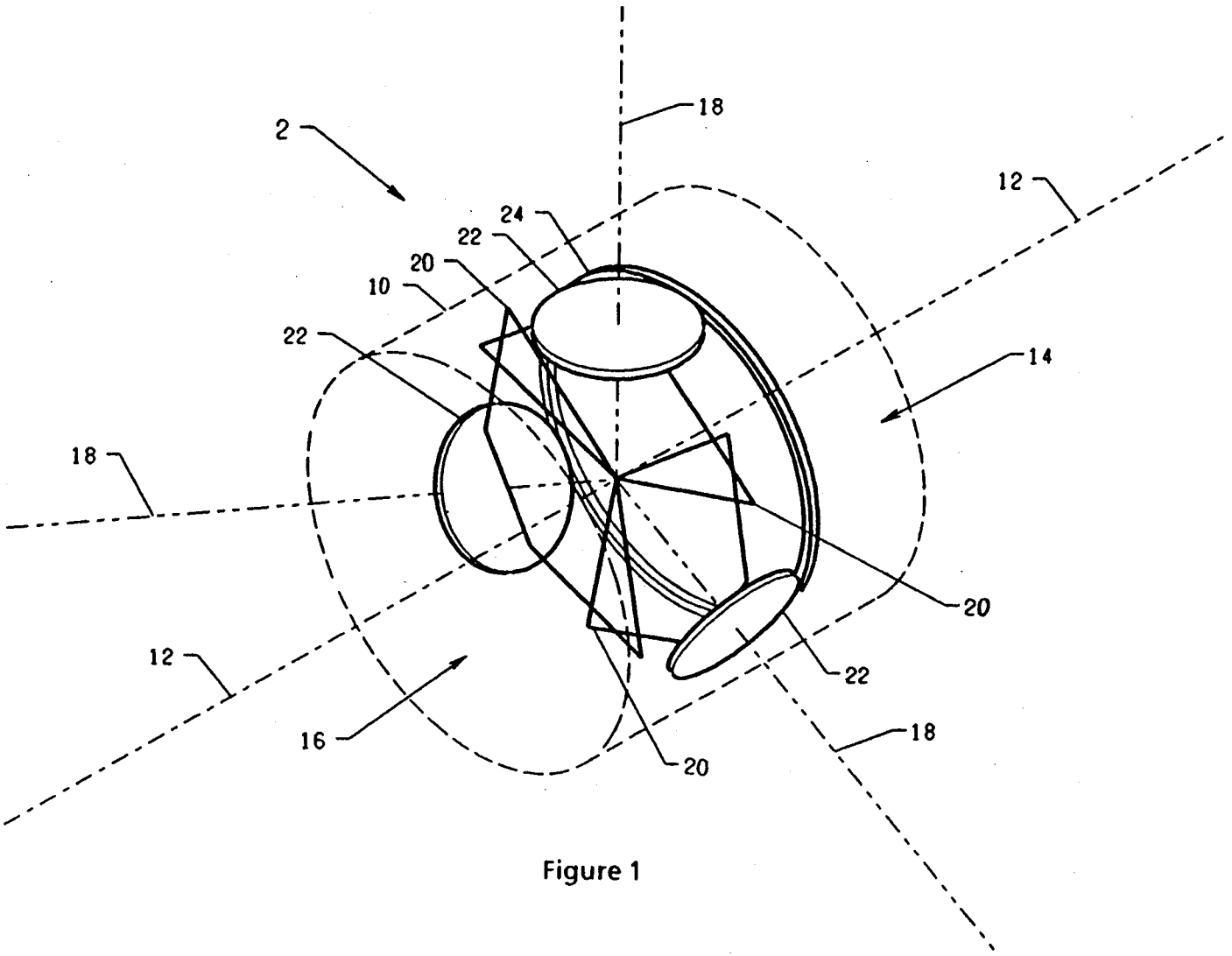
FIG. 1 is a schematic perspective view of a subassembly of pivotable filters in accordance with the present invention.

Referring now to FIG. 1, a pivoting-filter module or subassembly 2 which forms a part of the lighting instrument of the present invention will be described. The subassembly 2 is constructed within a tubular frame 10 (shown in phantom) having a longitudinal or primary axis 12 extending from an input aperture 14 to an output aperture 16. Three filters 20 are supported for rotation about respective axes 18 which preferably intersect the primary axis 12 to provide a radial arrangement when viewed from either end in the direction of the axis 12. The filters 20 comprise dichroic filters having identical optical characteristics and are pivotably supported near the axis 12 in a manner such as that described below with reference FIGS. 5B and 5C. The filters 20 are supported at their outer ends by gear wheels 22 which are interconnected by a suitable drive mechanism, such as ring gear 24, whereby all the wheels rotate simultaneously and at the same angular velocity.

The filters 20 can be pivoted about their axes 18 from a closed position as depicted in FIG. 1. to an open position in which they are substantially parallel to the primary axis 12. It will be appreciated that the filters 20 may be rotated to any intermediate position between the aforementioned positions. The subassembly 2 is further characterized in that all filters therein are presented at the same angle to a light beam which is parallel to the primary axis 12 and passes through the filters.

The subassembly 2 is adapted to receive a white light beam through the input aperture 14, selectively change the color of the light beam as the beam passes through the filters 20, and transmit the colored light beam through the output aperture 16. When the dichroic filters 20 are in the closed position, it will be appreciated that virtually all of the rays of the light beam are intercepted by the filters. When the dichroic filters 20 are rotated to the other extreme position in which they are parallel to the longitudinal axis 12, essentially none of the rays of the light beam are intercepted by the filters. By positioning the filters 20 at selected positions between such extreme positions, the hue and saturation of the resulting light beam can be varied in a controlled manner.

The dynamic color-changing effects achieved by the present invention are determined by the characteristics of dichroic filters. The aforementioned U.S. Pat No. 4,392,187 discloses changing the angle of incidence of a dichroic filter relative to a light beam to cause the color spectrum transmitted through the filter to be varied. Dichroic filters work on an interference principle, essentially separating two colors out of a white light source, one color being transmitted and the other color, the complement of that being transmitted/ being reflected. The color transmitted through the dichroic filter depends upon the types of material used in the filter layers and their refractive indices, the thickness of each layer., the number of the layers, and the angle of incidence of the white light source striking the surface of the filter. By varying the angle of incidence of the filters, a preselected range of colors may be produced.

The dichroic filters for use with the present invention may comprise numerous commercially available filters made from dielectric film coating on glass or the like. The dichroic film is made of multiple layers in which alternate layers have low and high indexes of refraction, respectively.

Figure 2:
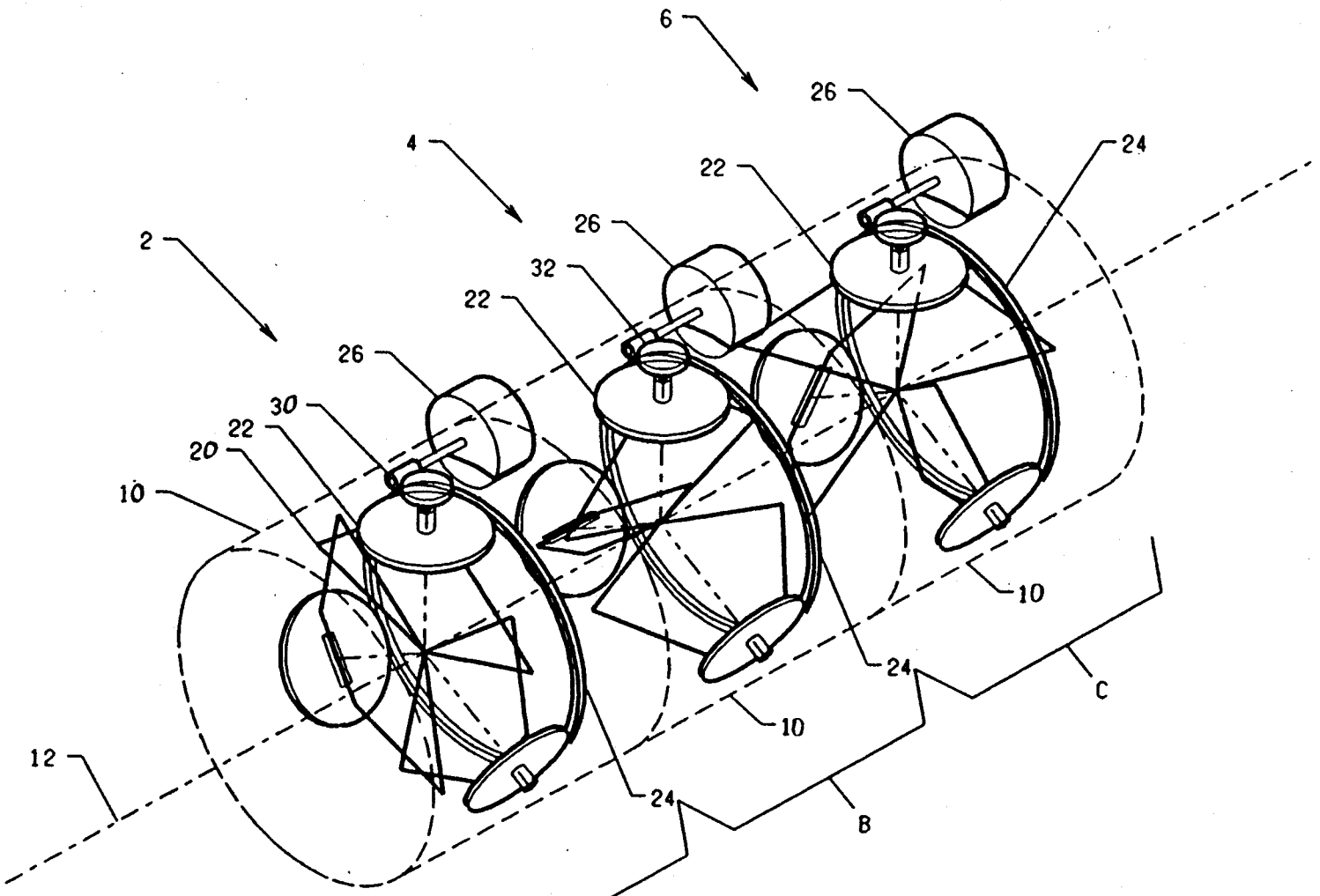
FIG. 2 is a schematic perspective view of three adjoining subassemblies or modules of pivotable filters showing different filter orientations.

Referring now to FIG. 2, three subassemblies or modules 2, 4 and 6 are connected in optical series relationship with their frames 10 (shown in phantom) abutting to form a single tubular arrangement. Each module has a set of three dichroic filters which are pivotable in the manner described above with reference to the filters 20 of FIG. 1.

The sets of filters of FIG. 2 are shown rotated to different positions. Module 2 shows filter set A with its filters in the closed position in which they intercept substantially all of the light rays passing through module 2.

Module 4 shows filter set B with its filters alighted substantially parallel to the longitudinal axis 12. This position will be referred to as the open position in which the filters intercept essentially none of the light rays passing through the module.

Module 6 shows filter set C with its filters disposed in an intermediate position between the open and closed positions. The actual intermediate position shown in FIG. 2 is such that the planes defined by the filters of set C are each disposed at 45-degree angles to the longitudinal axis 12

In the embodiment shown in FIG. 2, all of the filters of each set have their axes of pivotable movement intersecting the primary axis 12 at a common point. In the preferred embodiment, the axes of pivotal movement of the filters of each set define a radial plane. The present invention contemplates various alternative configurations in which the filters of each set are staggered in position so that their axes do not intersect the primary axis 12 at a common point. In one such configuration, the axes of pivotal movement of the filters within each set are spaced apart slightly along the primary axis 12 so that the filters, when in the closed position, have the appearance of stairs in a spiral staircase.

In a preferred arrangement, the filters of set A consist of long-wave pass amber filters, the filters of set B consist of short-wave pass blue filters, and the filters of set C consists of complex-color magenta filters. In such an arrangement, the lighting instrument is capable of producing a large selection of beam colors due to the combined effect of the three sets of filters in series.

It will be appreciated that at least some degree of white light is passed through module 6 if the filters therein are positioned in intermediate positions other than a range of positions near the closed position. In like manner white and colored light leaving module 6 may pass partially around the filters of module 4 if they are not in the closed or near the closed position. The same is true of light passing through module 2.

Figure 3:
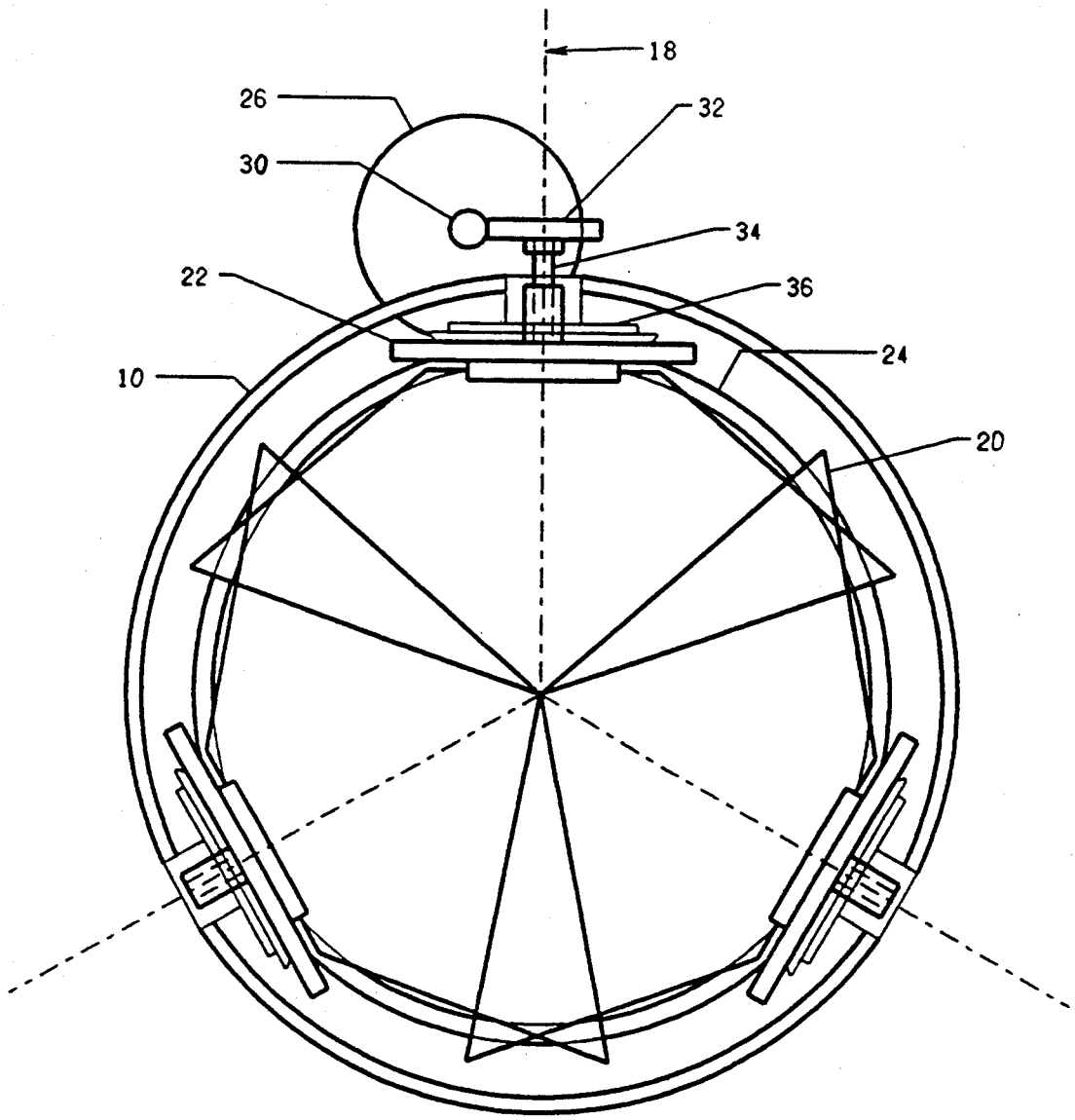
FIG. 3 is a schematic end view of the embodiment of FIG. 2.

Referring now to FIG. 3, a preferred drive mechanism for pivoting the filters 20 will be described. Each set of three filters is pivoted under the control of a bi-directional stepper motor 26 mounted to the frame 10 in a suitable manner (not shown). The shaft 28 of the motor 26 terminates in a worm gear 30. A worm wheel 32 is mounted on one of the filter supporting wheels 22 by means of a drive shaft 34. Each filter supporting wheel 22 has a geared periphery which engages complementary gear teeth on ring gear 24 as schematically depicted in FIGS. 2 and 3. Because the filter supporting wheels 22 are the same size and each is riven by a ring gear 24 common to each module, all three filters of each module are rotated in synchronization. The motor 26 may be energized by a conventional control system (not shown) comprising motor driver circuits, feedback sensors, and suitable electronic control circuits. Referring again to FIG. 2, it will be appreciated that each filter set A, B and C is independently pivotable under the control of a separate drive motor 26.

Figure 4:
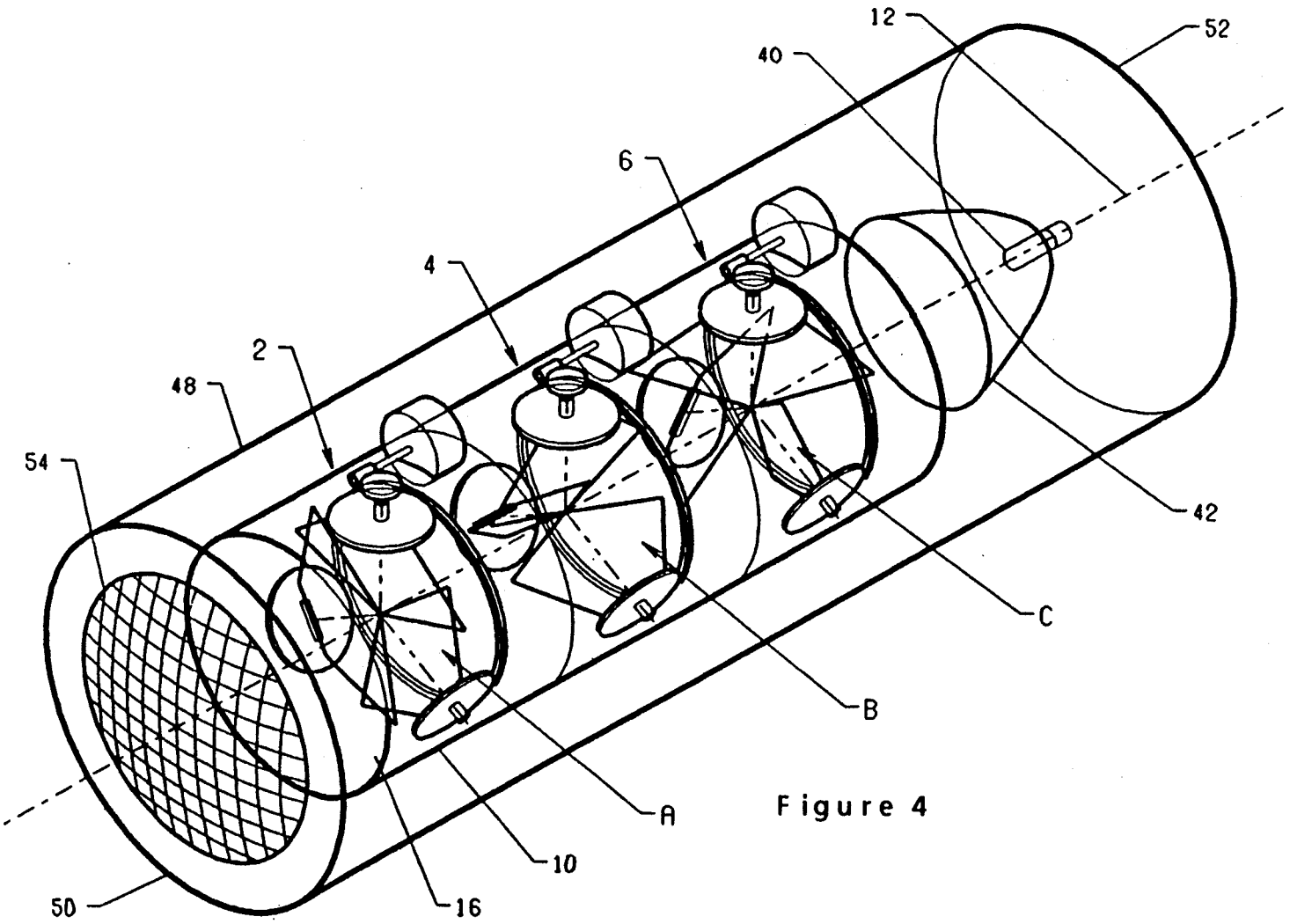
FIG. 4 is a schematic perspective view of a lighting assembly including the three modules of FIG. 2 enclosed within a cylindrical housing in accordance with one embodiment of the present invention.

Referring now to FIG. 4, a lighting instrument including the assembly of FIG. 2 is shown assembled in a cylindrical exterior housing 48. It will be appreciated that housing shapes other than cylindrical may also be employed. The housing 48 provides a means for mounting and protecting the filter modules and other components to be described. Conventional mounting hardware (not shown) is employed. The housing 48 is closed at the front end by bulkhead 50 and at the back end by bulkhead 52.

A lamp 40 and reflector 42 are mounted on the back bulkhead 52. The lamp 40 and reflector 42 serve as a light source to project a beam of light along the longitudinal axis 12. The beam first passes through pivoting filter set C, then passes through pivoting filter set B, and finally passes through pivoting filter set A.

A lenticular front glass 54 is also disposed transverse to axis 12, and intercepts the beam of light after the beam passes through pivoting filter set A. The glass directs the beam to provide a beam shape characteristic of wash luminaries. The glass is mounted in an aperture centered in front bulkhead 50.

The lighting instrument of FIG. 4 may be employed as one of many such instruments in an automated system such as described in the Bornhorst '187 patent. In such a system, means are provided for suspending the lighting instrument, controlling its orientation and controlling such beam parameters as divergence and intensity. The lighting instrument of FIG. 4 depicts a unique arrangement of pivotal filters for controlling beam color and saturation.

To control beam intensity, lamp 40 may be a low-voltage incandescent type, such as a tungsten-halogen lamp, and may be coupled to an electronic dimmer (not shown). Alternately, lamp 40 may be an arc lamp, such as a metal-halide discharge lamp and may be modulated in brightness or intensity by conventional mechanical dimming means (not shown) mounted within housing 48.

Figure 5A:
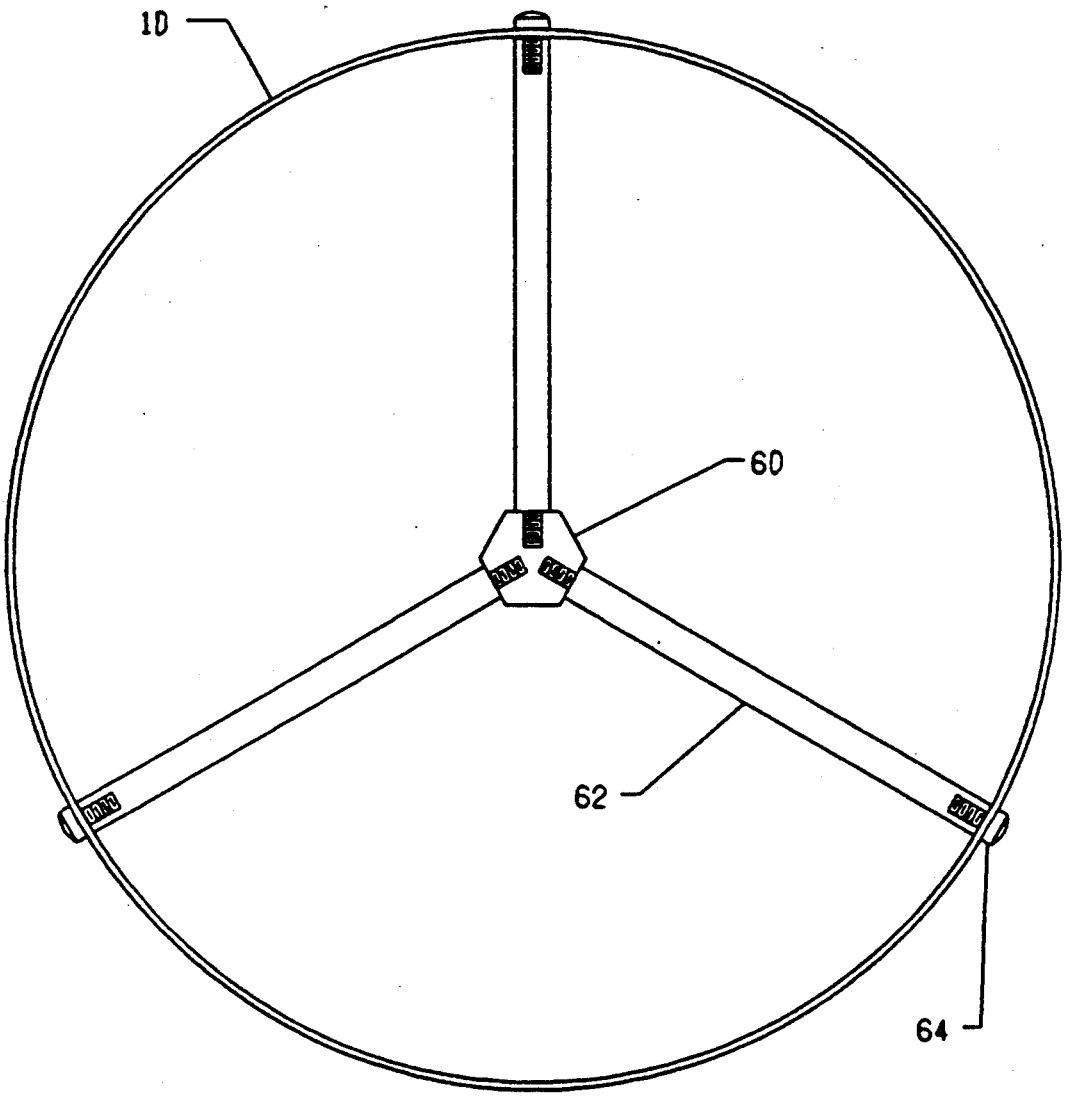
FIG. 5A is a cross-sectional view of a cylindrical frame showing a preferred center support according to the present invention.

A preferred technique for supporting the filters in tubular frame 10 is illustrated in FIG. 5A. A center support member 60, which preferably is a long aluminum bar of hexagonal cross-section, is supported within frame 10 by radial arms 62. The arms 62 have threaded ends secured in the member 60. Threaded fasteners 64 secure the arms 62 to the frame 10.

Figure 5B:
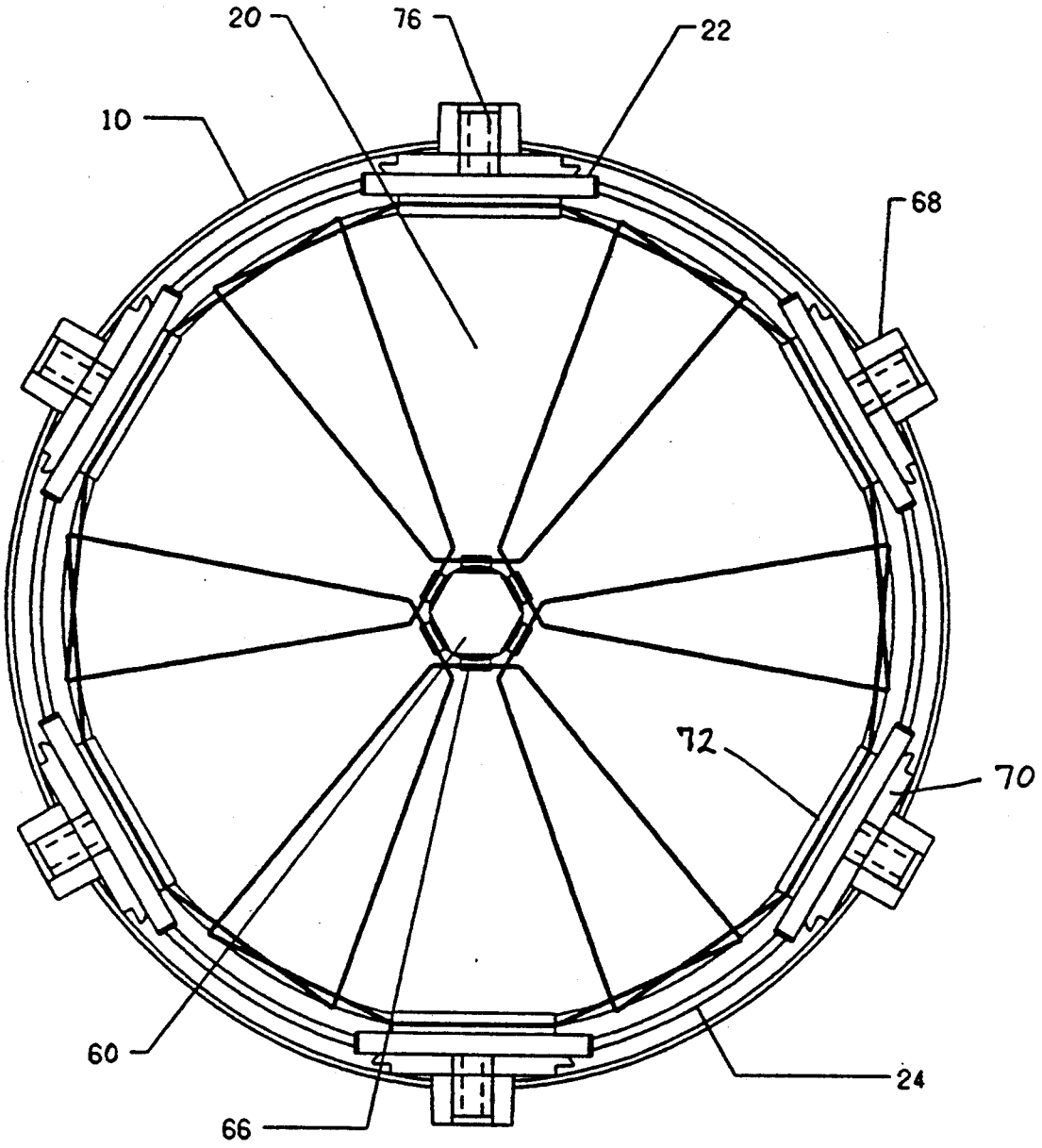
FIG. 5B is a radial cross-sectional view of a cylindrical frame showing one module of six pivotable filters used in a stage light according to another embodiment of the present invention.
Figure 5C:
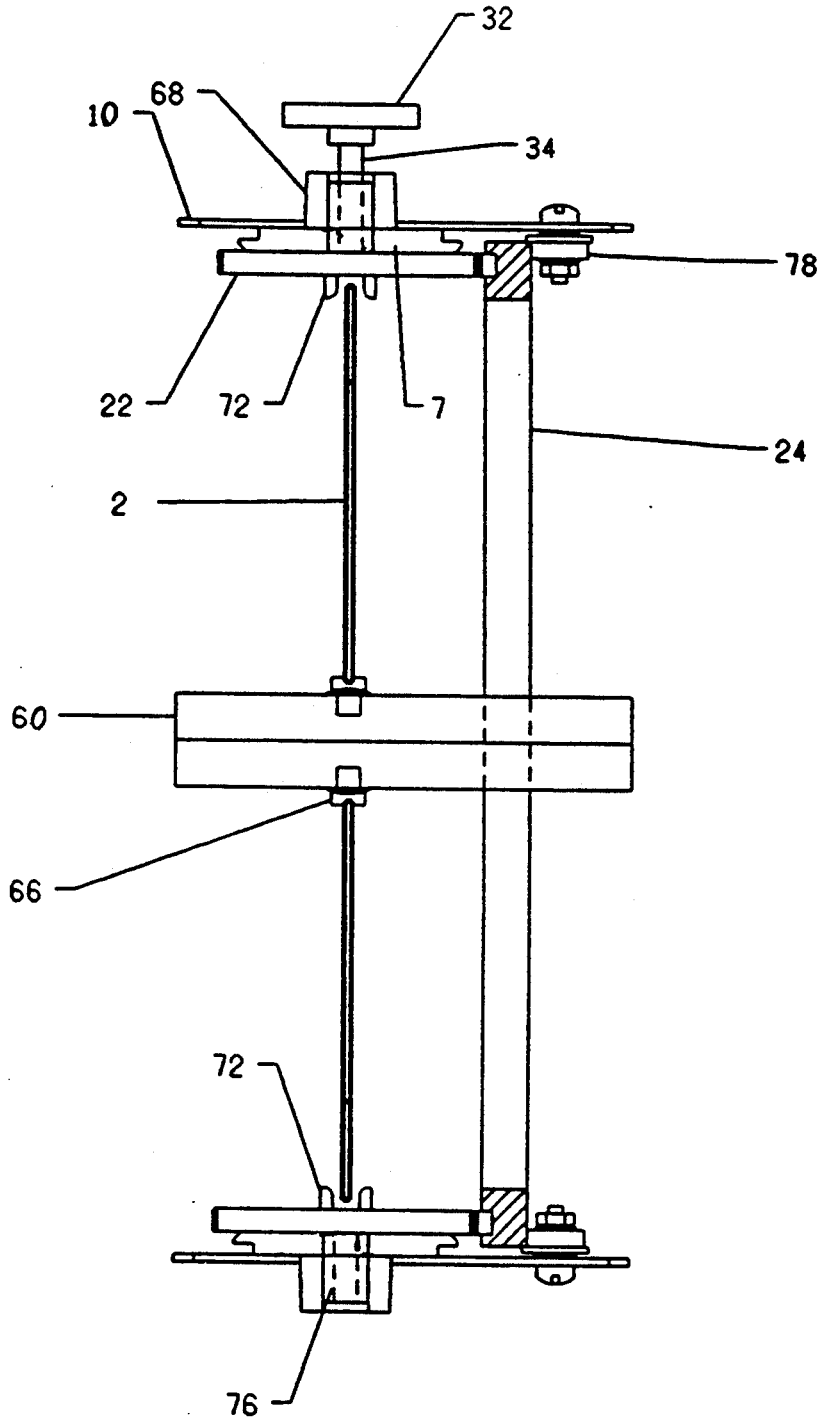
FIG. 5C is an axial cross-sectional view of the embodiment of FIG. 5B.

Referring now to FIGS. 5B and 5C, an alternate arrangement of six dichroic filters is shown arranged radially about center support member 60. Each filter is fastened at its inner end to support member 60 by a U-shaped clip 66. Each clip 66 is rotatable with respect to the support member 60. Each filter 20 is supported at is outer end by a gear wheel 22 which has a U-shaped channel 72 on its inner fact for receiving the filter. Each gear wheel 22 is rotatably supported just inside the frame 10 by a bushing 68 secured in the frame wall. A low friction spacer or bearing 70 separates the gear wheel 22 from the bushing 68.

Each gear wheel has a hollow shaft 76 extending through the bearing 70 into the bushing 68. The material of the bushing 68 is chosen to present a minimum of friction between the bushing and the shaft 76 of the rotating gear wheel 22.

The gear wheels 22 are coupled for synchronous rotation by a ring gear 24, seen best in FIG. 5C. The ring gear 24 is maintained in engagement with the gear wheels by bearings 78 secured to the frame by suitable fastening means. To accomplish the rotation, one filter supporting wheel 22 is fitted with a drive shaft 34 which is inserted into the hollow shaft 76 of the selected wheel 22 and secured therein by a suitable adhesive. A worm wheel 32 is attached to drive shaft 34 to provide for motorized operation of the pivoting-filter assembly as described above with reference to FIG. 2.

Figure 5D:
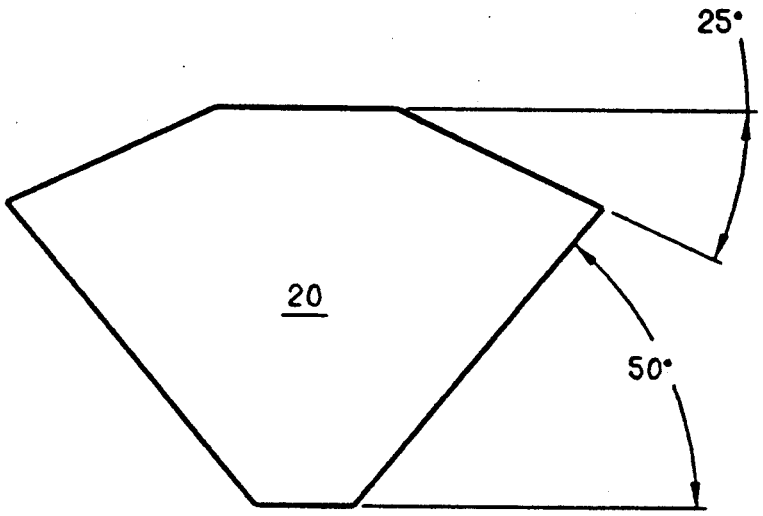
FIG. 5D is a plan view of one pivotable filter used in the embodiment of FIG. 5B.

The preferred shape of the filters employed in the embodiment of FIG. 5B is illustrated in FIG. 5D. The filter 20 is a six-sided irregular polygon having two parallel sides for mounting as described above. The shape of the filter is selected so that the arrangement of sic such filters depicted in FIG. 5B will intercept substantially all of the light rays of the light beam in the intermediate positions between the fully closed position and the 45 degree position (i.e., half way between the fully closed and fully open positions).

It will be appreciated that embodiments of the invention can be constructed with any number of filters. The six-filter per set embodiment of FIG. 5B is believed to provide an optimum stage-lighting instrument. The three-filter per set embodiment of FIG. 4 is more suitable for smaller track lighting instruments for use in offices and is easier to illustrate in perspective view than the embodiment of FIG. 5B. One skilled in the art will readily appreciate the resulting structure achieved by substituting three modules of the six-filter embodiment of FIG. 5B for the modules 2, 4 and 6 of FIG. 4.

Figure 6:
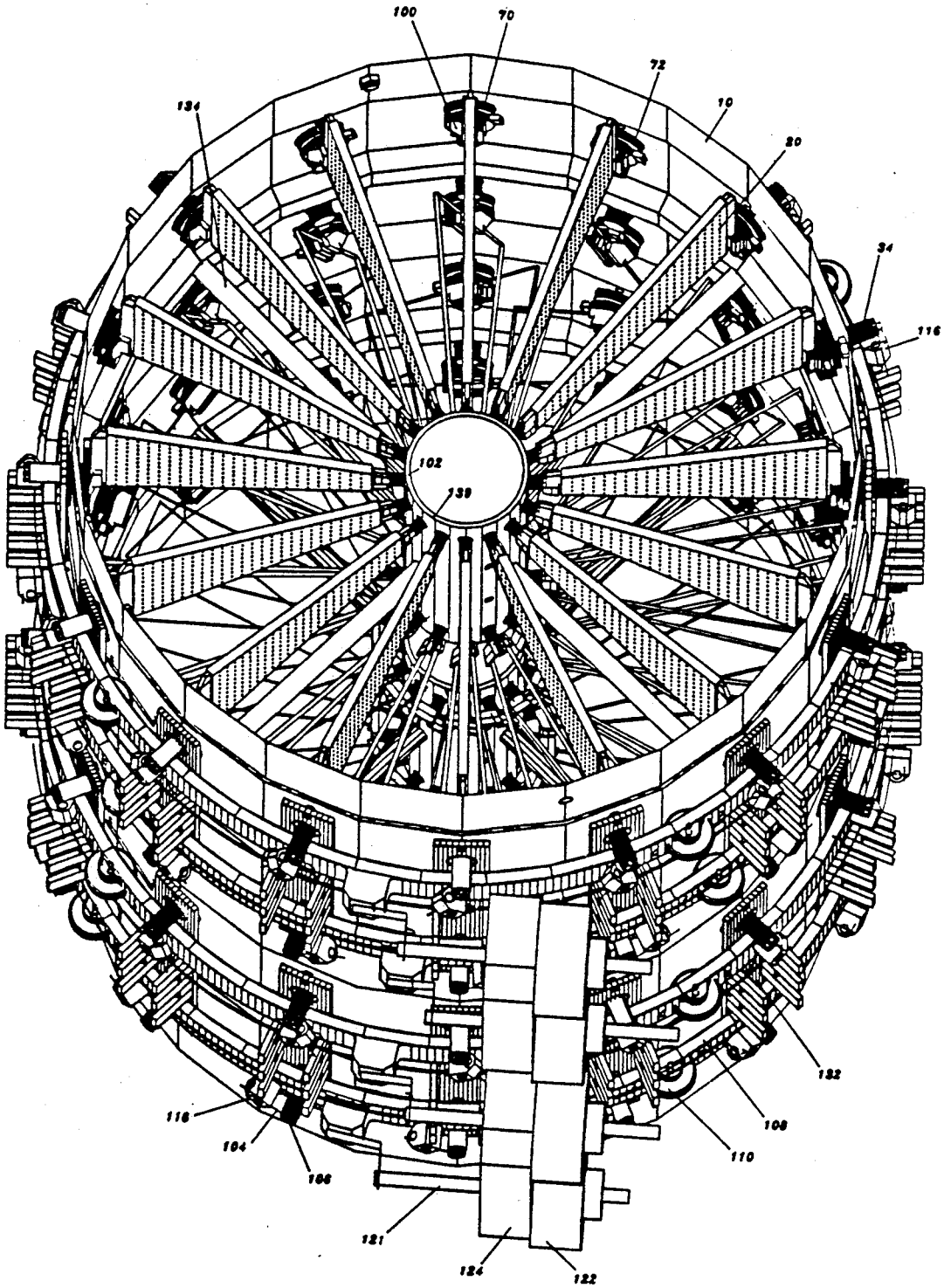
FIG. 6 is a perspective view of another embodiment of the lighting instrument illustrating multiple sets of filters mounted therein.

FIG. 6 illustrates a lighting instrument according to another embodiment of the present invention. This embodiment features an alternative filter actuation mechanism for providing improved actuation control. As shown in FIG. 6, the lighting instrument includes a cylindrical frame 10 and multiple sets of color filters 20 mounted therein. Each set of filters 20 is disposed spaced apart along the longitudinal axis of said frame. The filters 20 are supported within the cylindrical frame 10 by large filter carriers 100 and small filter carriers 102. Each of the large filter carriers 100 rotates within a bushing 70. Each of the large filter carriers 100 includes a channel 72 for receiving one of the color filters 20 and a carrier shaft 34, which extends through bushing 70 and protrudes through one of a plurality of openings along frame 10.

Figure 7:
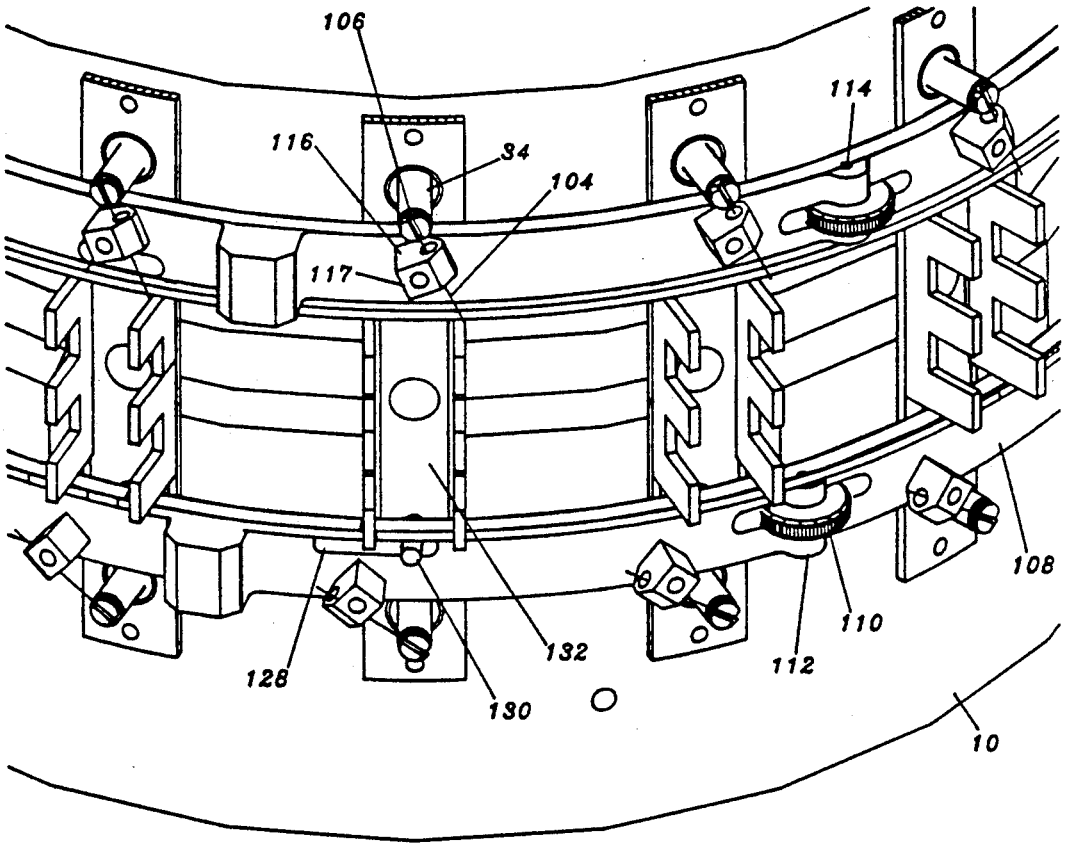
FIG. 7 is an expanded view illustrating the coupling mechanisms for the color filters according to the present invention.

FIG. 7 is an expanded view of an outside portion of frame 10, showing mechanisms for coupling two sets of color filters 20. A length of spring wire 104 is secured to carrier shaft 34 and extends outwardly through and from slot 106 at the end of carrier shaft 34. The outward extension of spring wire 104 includes a straight portion for actuation linkage with coupling block 116. The spring wire 104 is preferably made with stainless steel.

Each of the coupling blocks 116 is pivotally mounted on ring 108 with a mounting post 117 and includes a hole through which the straight portion of spring wire 104 extends. The ring 108 encircles frame 10 and is rotatably supported on frame 10 by a plurality of rollers 110 attached to tabs 112 on ring 108. Rollers 110 are secured to tabs 112 by axle pins 114 driven through holes formed in the tabs. The ring 108 is preferably made from a semi-flexible, high-temperature thermoplastic such as polyphenylene sulfide with glass fiber reinforcement, which is similar to the Ryton material manufactured by the Phillips Petroleum Company.

With the above coupling mechanism, it can be seen that rotation of the ring 108 about the center of the cylindrical frame 10 will cause the color filters 20 to rotate about their respective axes, each of the respective axes being generally transverse to the longitudinal axis of the cylindrical frame 10.

Figure 8:
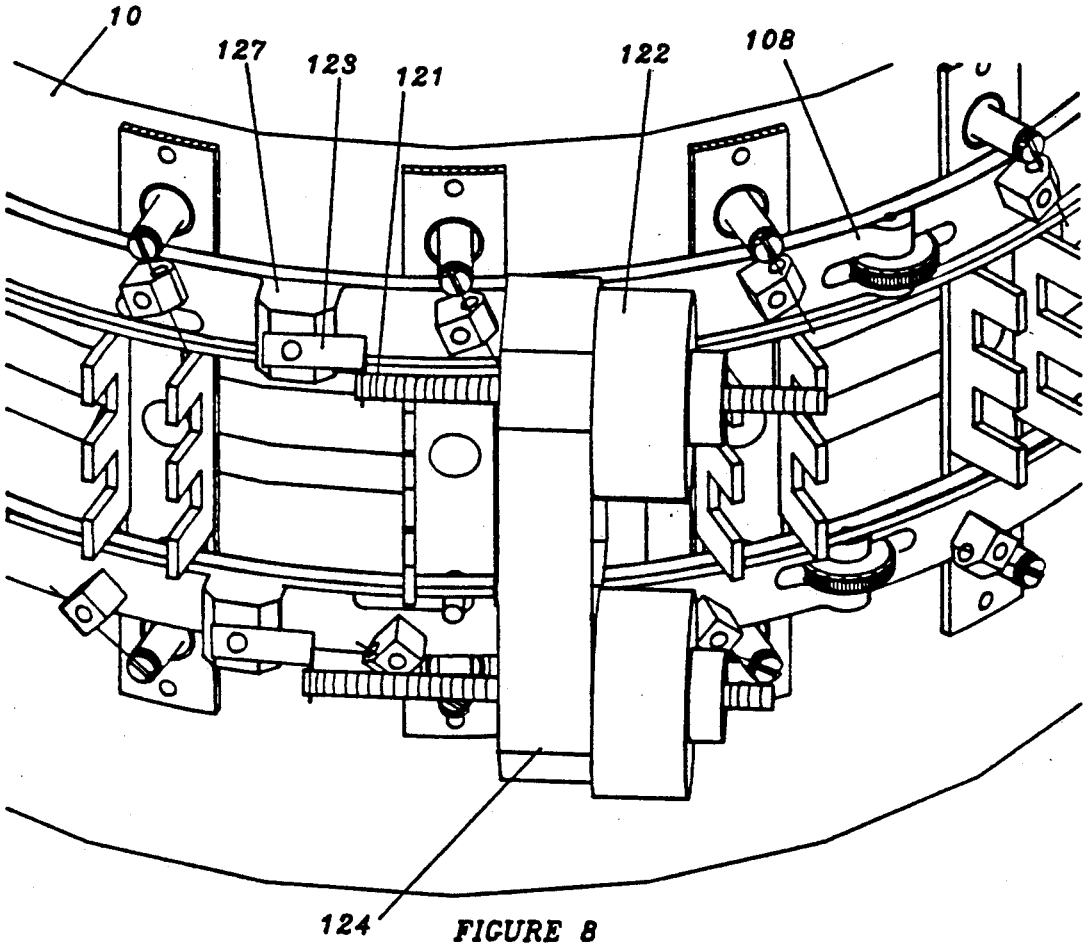
FIG. 8 is an expanded view of the drive mechanism according to the present invention.

FIG. 8 illustrates the driving mechanism according to the present invention. The driving mechanism may be a stepper motor 122 supported by a motor mount 124, which in turn is mounted on the frame 10. The stepper motor 122 includes a shaft 121 which is extended or withdrawn by the reversible action of the stepper motor 122. One end of the shaft 121 is engaged to a flexible bracket 123 which is preferrably made from spring steel. This bracket 123 is secured to a tab 127. The tab 127 is part of the ring 108. Thus, when the motor 122 is driven in one direction, the shaft 121 extends, pushing on bracket 123 and tab 127 and thereby rotating the ring 108 about the central or main axis 12 of frame 10 and substantially concentrically with respect to frame 10. When the motor 122 is driven in the reverse direction, the ring 108 correspondingly rotates in the opposite direction The coupling mechanisms including the filter carrier shaft 34, spring wire 104 and the coupling blocks 116 allow for at least three degrees of freedom of movement. First, as the ring 108 rotates back and forth and the coupling blocks 116 travel past the shafts 34, the coupling blocks 116 pivot on their mounting posts 117 to accommodate the changing angle between the coupling blocks 116 and the filter carrier shafts 34.

Second, the distance between the coupling block 116 and the filter carrier shaft 34 varies as the ring 108 rotates. The spring wire 104 passes through a hole in the coupling block 116, but is otherwise not attached to the coupling block 116. The straight portion of the spring wire 104 is long enough to remain flexibly linked to the pivoting coupling block 116 at either extremes of travel, thereby accommodating the varying distance.

Third, the angle of elevation of the coupling block 116 with respect to the end of the filter carrier shaft 34, as viewed from the end of the cylindrical frame 10, varies as the ring 108 rotates, owing to the curvature of the frame 10. The straight portion of the spring wire 104 bends slightly to accommodate the varying angle.

With the drive and coupling mechanisms according to this embodiment of the invention, the filters 20 can be actuated through moving components having significantly reduced amounts of friction. Thus, the movement of the filters 20 and the filter carriers 100 has a very low backlash, especially when compared with a gear-driven arrangement. Therefore, a more energy efficient actuation mechanism with more precise actuation control is obtained.

Another improvement derivable from the present embodiment is attributed to the flexibility of the ring 108, which allows the cylindrical frame 10 to stray from being perfectly circular in cross section. The frame 10 may then be a relatively inexpensive sheet metal as opposed to a precision casting. If the frame 10 is slightly out-of-round, the semi-flexible ring 108 compensates for small distortions in the shape of the frame, riding over the slightly varying surface on the rollers 110.

Again, referring to FIG. 7, the semi-flexible ring 108 includes a plurality of slots 128 through which a guide post 130 can be inserted. The guide post 130 is attached to a carrier mounting bracket 132, which in turn is mounted on frame 10. As ring 108 rotates substantially concentrically with respect to the cylindrical frame 10, slots 128 and guide posts 130 maintain the longitudinal position of ring 108 and also limit the extent of travel of ring 108 around the frame 10.

Thus, the ring 108 is maintained in substantially the same longitudinal position so that spring wires 104 do not come out of the holes in pivoting coupling blocks 116. The extent of travel of ring 108 is physically limited by slots 128 and guide post 130 so that the ring 108 cannot be overdriven to the extent that the pivoting coupling arrangement is damaged.

The large color filter carriers 100 also incorporate travel-limiting features. As shown in FIG. 10, large filter carriers 100 include two end-of-travel stops 140 and 142 molded therein to limit the range of rotation of the filters 20. The angle between the two stops is carefully chosen so that the color filters 20 are parallel to the longitudinal axis 12 when fully open, and so that the color filters 20 do not touch each other when fully closed Again referring to FIG. 7, the length of slots 128 is carefully chosen so that ring 108 can be driven slightly farther in the open direction than filter carriers 100 will pivot. Spring wires 104 bend slightly in such a case so the flexible couplings are not damaged. Stepper motors 122 can be controlled by a microprocessor and memory based control system such as the system described in U.S. Pat. No. 4,980,806 to Taylor et al., the disclosure of which is incorporated herein by reference. When the control system is initialized, the motor control subsystem calibrates the mechanism by driving the stepper motors 122 in the direction which opens the color filters 20. The motors are driven to the physical end-of-travel stops to ensure that all color filters 20 are set to a known position parallel to the main longitudinal axis 12 of the lighting instrument. No end-of-travel sensors are required, as the motor control subsystem can simply drive the stepper motor a few steps more than the number of steps required for the full range of travel, and thereafter begin counting and recording the number of steps moved. The control system maintains in memory a record of the current position of the corresponding filter set. The filters may then be driven open-loop, eliminating any requirements for end-of-travel sensors and control circuitry interface with such sensors.

Figure 9:
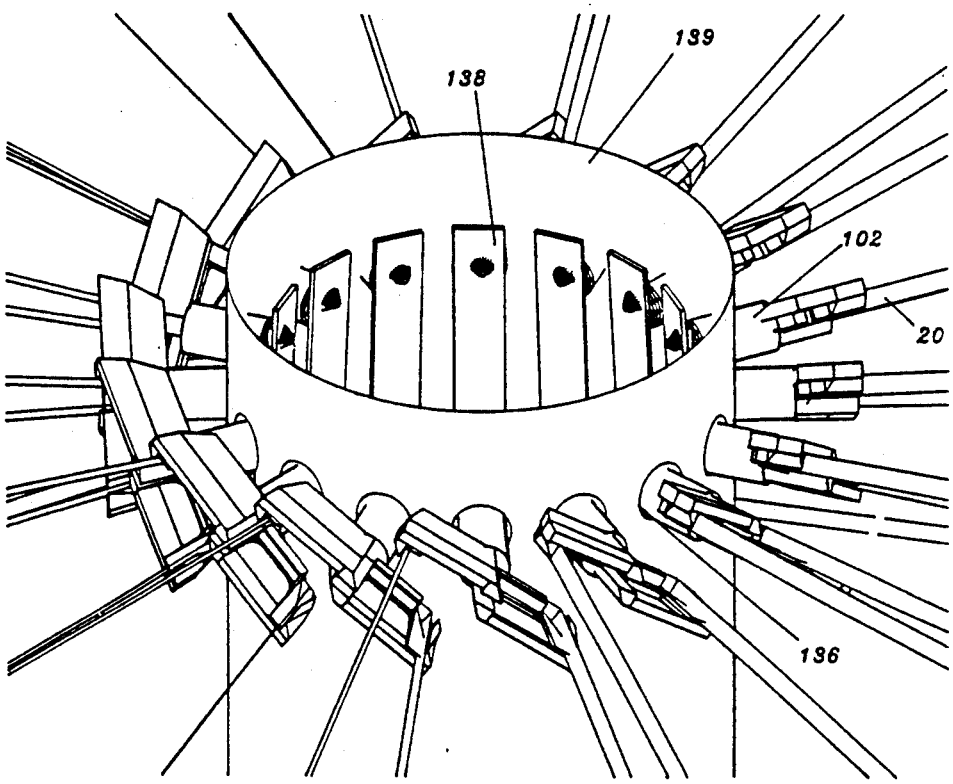
FIG. 9 is an expanded view illustrating the mounting of the pivoting filter carriers to an axial hub.
Figure 10A:
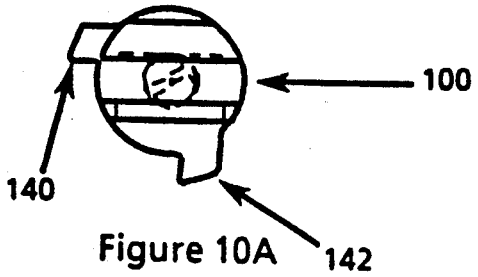
FIGS. 10A–10D illustrate the top, front bottom and side views of a filter carrier respectively.
Figure 10B:
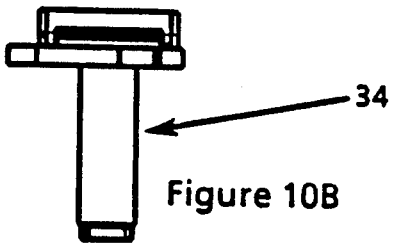
Figure 10C:
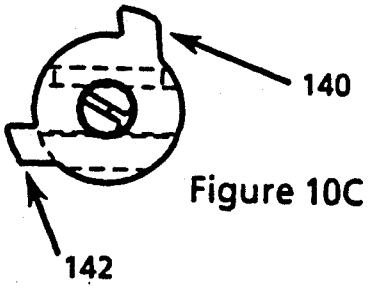
Figure 10D:
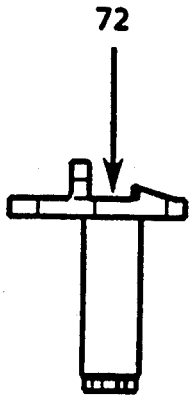

Another feature of the present invention relates to the mounting arrangement of the filters 20 and small filter carriers 102. FIG. 9 is an expanded view of a portion of the light instrument at or near the hub 139. As shown in FIG. 9, the hub 139 is suspended within frame 10 by support rods 134. The hub 139 includes a plurality of holes 136 into which are inserted small filter carriers 102. A compression apparatus, such as finger springs 138, mounted within hub 139 exerts pressure on the ends of small filter carriers 102 to press the combination of small filter carriers 102, filters 20, and large filter carriers 100 against bushing 70 mounted on the inner surface of frame 10. The finger springs 138 maintain the radial alignment of the coupling mechanisms including coupling blocks 116 and spring wires 104.

The present invention also contemplates applications other than for stage lighting. For example, a large lighting apparatus such as a search light for illuminating the night sky with different colored beams can be constructed using the foregoing techniques. In such an embodiment of the invention, a much larger number of pivoting filters is contemplated so as to minimize the axial dimension of the filter assembly. It will be appreciated that the disclosed radial arrangement of filters is ideally suited to the projection of a circular light beam and provides economic and performance advantages over square or rectangular filter arrangements.

It will be understood that the present invention is not limited to the embodiments disclosed, but is capable of rearrangements, modifications, substitution of equivalent parts and elements without departing from the spirit of the invention as defined in the following claims:

What is claimed is:

1. In a lighting instrument comprising a frame having a longitudinal axis; first and second longitudinally spaced sets of color filters supported by the frame, each color filter being characterized in that light passing through the filter varies in color depending upon the angular orientation of the filter with respect to the light beam, the filters of each set being pivotable about axes intersecting the longitudinal axis; first and second annular actuating members supported by the frame and rotatable about the longitudinal axis; first set of pivoting actuators coupling filters of the first set to the first annular actuating member; second set of pivoting actuators coupling filters of the second set to the second annular actuating member; first drive means for driving the first annular actuating member for pivoting the first set of filters; and second drive means for driving the second annular actuating member for pivoting the second set of filters independently from the pivoting action of the first set of filters; the improvements comprising:

a semi-flexible ring utilized as either said first or said second annular actuating member, said ring encircling the frame and being supported on said frame by a plurality of rollers, said ring and said rollers comprising an actuating member adaptable to deviations in the circularity of said frame; and a plurality of flexible coupling means coupling said filters to said ring.

2. The lighting instrument of claim 1, said coupling means including a plurality of coupling blocks pivotally mounted on said ring, and a plurality of pivoting filter carriers each having a shaft passing through said frame, said carriers including a flexible rod coupled to said shaft, said rod extending through a hole formed in said coupling blocks.

3. The lighting instrument of claim 1, further including: a hub mounted within said frame, said hub including a plurality of receptacles supporting a plurality of filter carriers supporting said filters, said hub further including compressing devices mounted within the hub, said compressing devices engaging the filter carriers supported on said hub, said compressing devices urging said filter carriers against an inner surface of said frame.

4. The lighting instrument of claim 1, further including: a plurality of slots formed in said ring, and a plurality of guide pins secured to said frame, said guide pins passing through said slots, said slots and said guide pins comprising axial positioning means maintaining the position of said annular actuating members along the longitudinal axis of said frame;

5. A lighting instrument comprising:

a frame having a longitudinal axis, said frame includes at least one set of openings disposed at spaced-apart intervals along the perimeter of said frame;

at least one set of color filters for varying the color of light passing through the filters, said filters being disposed generally radially about said longitudinal axis, each of said filters being rotatably mounted for rotation about an axis generally transverse to the longitudinal axis;

a motor having a motor shaft;

a ring disposed substantially concentrically with respect to said frame and rotatably supported on said frame, said ring includes a connecting member for engaging said motor shaft for rotating said ring correspondingly to the rotation of said motor;

a plurality of coupling blocks pivotally mounted on said ring; and means for flexibly linking said filters to said coupling blocks through said openings in said frame for rotating each of said filters about its respective axis when said ring rotates about said longitudinal axis.

6. The lighting instrument of claim 5 further including a plurality of pivoting filter carriers for supporting said filters.

7. The lighting instrument of claim 6, wherein said filter carriers include means for limiting the range of rotation of said filters in a first position in which the color filters are parallel to the longitudinal axis and a second position in which the edge portions of the color filters overlap without contact.

8. The lighting instrument of claim 5, further including a hub mounted within said frame, said hub including means for flexibly engaging said color filters.

9. The lighting instrument of claim 5, further including a plurality of guide pins secured to said frame and a plurality of slots formed in said ring for passing through said guide pins for maintaining the position of said ring along the longitudinal axis of said frame.

10. A lighting instrument comprising:

a frame having a longitudinal axis;

a light source disposed at one end of the frame for projecting a beam of light through the frame in the direction of the longitudinal axis;

at least one set of color filters for varying the color of light passing through the color filters, said color filters being disposed generally radially about said longitudinal axis;

a semi-flexible ring disposed about the circumference of said frame and flexibly coupled to said color filters; and a drive mechanism coupled to said ring for rotating each filter about an axis of rotation generally transverse to said longitudinal axis.

11. The lighting instrument of claim 10 wherein said ring is supported on said frame by a plurality of rollers.

12. The lighting instrument of claim 10 wherein said ring includes slots for passing guide pins, said guide pins are secured to said frame for maintaining the position of said ring along the longitudinal axis of said frame.

13. The lighting instrument of claim 10, further including a plurality of filter carries and a hub mounted within said frame having means for flexibility engaging the filter carriers and urging said filter carries against an inner surface of said frame.

14. The lighting instrument of claim 10 wherein said drive mechanism is controllable by a microprocessor.

15. The lighting instrument of claim 10 wherein said drive mechanism includes drive data stored in memory.

16. The lighting instrument of claim 10 wherein said drive mechanism is remotely controlled.

* * * * *